US010577823B1

(12) United States Patent
Coleman et al.

(10) Patent No.: US 10,577,823 B1
(45) Date of Patent: Mar. 3, 2020

(54) FENCE REPAIR DEVICE

(71) Applicant: ESK, LLC, Plant City, FL (US)

(72) Inventors: Earl W. Coleman, Plant City, FL (US); Steven R. Haigler, Plant City, FL (US); Kenton V. Pickens, Wesley Chapel, FL (US)

(73) Assignee: ESK, LLC, Plant City, FL (US)

( * ) Notice: Subject to any disclaimer, the term of this patent is extended or adjusted under 35 U.S.C. 154(b) by 295 days.

(21) Appl. No.: 15/429,331

(22) Filed: Feb. 10, 2017

Related U.S. Application Data

(60) Provisional application No. 62/295,229, filed on Feb. 15, 2016.

(51) Int. Cl.

| | |
|---|---|
| ***E04H 17/02*** | (2006.01) |
| ***E04H 17/04*** | (2006.01) |
| ***E04H 17/06*** | (2006.01) |
| ***E04H 17/26*** | (2006.01) |
| ***E04G 23/02*** | (2006.01) |

(52) U.S. Cl.
CPC ..... *E04H 17/04* (2013.01); *E04G 23/02* (2013.01); *E04H 17/06* (2013.01); *E04H 17/268* (2013.01)

(58) Field of Classification Search
CPC ... Y10T 403/5733; F16L 21/005; F16L 21/06; F16L 25/14; F16L 17/04
USPC ..... 403/301, 305, 306; 285/419, 373, 235, 285/236
See application file for complete search history.

(56) References Cited

U.S. PATENT DOCUMENTS

| | | | | |
|---|---|---|---|---|
| 367,584 | A * | 8/1887 | Bartliff | F16B 7/0413 403/301 |
| 1,208,361 | A | 12/1916 | Olson | |
| 1,517,846 | A | 12/1924 | Lewis | |
| 1,598,592 | A | 8/1926 | Barrett | |
| 1,617,447 | A | 2/1927 | Johnston | |
| 1,982,569 | A | 11/1934 | Byrd | |
| 1,983,850 | A | 12/1934 | Gordon | |
| 1,995,874 | A | 3/1935 | Van de Mark | |
| 2,162,123 | A * | 6/1939 | Richter | E21B 17/046 403/305 |
| 2,395,745 | A | 2/1946 | King | |
| 2,704,677 | A | 3/1955 | Quest | |
| 2,713,352 | A | 7/1955 | Schustack | |
| 4,470,622 | A * | 9/1984 | Pate | F16L 3/1236 285/419 |
| 7,240,930 | B2 * | 7/2007 | Stravitz | D06F 58/20 285/148.26 |
| 8,690,194 | B1 * | 4/2014 | Smith | F16L 25/0036 285/149.1 |
| 8,944,474 | B2 * | 2/2015 | Serizawa | F16L 3/1091 285/373 |

(Continued)

*Primary Examiner* — Joshua T Kennedy
(74) *Attorney, Agent, or Firm* — Frijouf, Rust & Pyle, P.A.

(57) ABSTRACT

A pipe coupler is disclosed for the repair of a damaged top rail of a cylindrical chain link fence pipe. The pipe coupler comprises a pipe coupler having a cylindrical body wall including a primary socket and a secondary socket. The primary socket and the secondary socket have a larger cylindrical diameter than the cylindrical top rail of the chain link fence for slidably engaging with the ends of the top rail portions. The pipe coupler has a socket door for covering a socket grove which prevents the separation of a replacement cylindrical rail portion or an existing cylindrical rail portion. A flexible strap and a clamp are used to keep the socket door closed.

8 Claims, 9 Drawing Sheets

(56) References Cited

U.S. PATENT DOCUMENTS

| | | | | |
|---|---|---|---|---|
| 9,566,740 | B2 * | 2/2017 | Valola | B29C 53/08 |
| 2003/0163960 | A1 | 9/2003 | Hadden | |
| 2007/0036938 | A1 | 2/2007 | Engelbrecht | |
| 2008/0284162 | A1 | 11/2008 | Piscitelli | |
| 2009/0236579 | A1 | 9/2009 | Sudnak | |
| 2009/0308017 | A1 | 12/2009 | Kadoya et al. | |
| 2010/0088995 | A1 | 4/2010 | Murayama et al. | |
| 2012/0255259 | A1 | 10/2012 | Shute | |
| 2015/0013267 | A1 | 1/2015 | Huncovsky | |
| 2015/0082742 | A1 | 3/2015 | Catt et al. | |

* cited by examiner

FENCE REPAIR DEVICE

CROSS-REFERENCE TO RELATED APPLICATIONS

This application claims benefit of U.S. Patent Provisional Application No. 62/295,229 filed Feb. 15, 2016. All subject matter set forth in U.S. Patent Provisional Application No. 62/295,229 is hereby incorporated by reference into the present application as if fully set forth herein.

BACKGROUND OF THE INVENTION

Field of the Invention

This invention relates to a pipe coupling devices and more particularly to a cylindrical top rail coupling device for a chain link fence.

Background of the Invention

Chain link fences are a very common fence in both residential and commercial properties. Chain link fences are typically created using a metal or aluminum material. Chain link fences have various parts which includes a cylindrical top rail that run across the top of the fence. The cylindrical top rail's function includes holding up the chain link fabric and maintaining structure for the fence. The cylindrical top rail of a chain link fences are easily damaged from falling tree limbs or any weight that exceeds the cylindrical top rail's material strength. Damage to the cylindrical top rail allows the link fabric to sag, making the fence visually unappealing and partially non-functional.

Repairing a damage cylindrical top rail typically requires a fencing company to come out and spend several hours installing a new cylindrical top rail. Replacing the cylindrical top rail requires the fencing company to remove many undamaged sections of the fence to install the new portion of the cylindrical top rail.

Attempts to simplify the repair of a damaged cylindrical top rail have varying degrees of success. None, however completely satisfies the requirements for a complete solution to the aforestated problem. The following U.S. Patents are attempts of the prior art to solve this problem.

U.S. Pat. No. 731,752 to Cadwell discloses a fence-post, the combination with an upper and a lower section formed of wood; of a section formed of metallic strips bent transversely to conform to the surface of said section to which they are secured to space the adjacent ends of the sections apart and also rigidly unite the same, said strips each being formed with a tubular stiffening-rib along its longitudinal center line and provided with a stiffening-wire which is inserted in said rib and bent over at its ends; and a filling of cement within the space between the ends of the sections and the strips.

U.S. Pat. No. 1,208,361 to Olson discloses a combination with a fence post, of a lateral brace comprising a pair of pipe sections telescopingly joined, one of the pipe sections being connected to said post and the other to an opposed support, and means fixedly securing the pipe sections together at their joined portions comprising band clamps embracing and clamped to each pipe section, and a connection between the clamps holding them in fixed relative relation.

U.S. Pat. No. 1,517,846 to Lewis discloses a shield for poles and the like formed of fire proof material and comprising separate sections, means detachably connecting the sections to provide a pole receiving sleeve, said sleeve having a horizontal row of spaced openings therein to define water outlets and baffles extending across said openings.

U.S. Pat. No. 1,598,592 to Barrett discloses a pole yieldingly set and bedded in the ground, and invested, at the ground line, in an adherent flexible bituminous protective jacket itself directly embedded in the ground.

U.S. Pat. No. 1,617,447 to Johnston discloses in combination, a wooden member, a band composed of a cement composition surrounding said member, and a layer of sulphur applied in the molten condition between said band and said member. The method of preserving woolen elements which comprises forming a suitable band of concrete to surround the element to be preserved, placing said band around said element, and applying molten sulphur between said element and said band.

U.S. Pat. No. 1,982,569 to Byrd discloses a protective device for poles comprising a tubular metallic sleeve having its major portion embedded in the ground with one end thereof projecting a limited distance above the surface of the ground to receive a pole with the latter spaced from the walls thereof, an internal flange formed integral with the sleeve and located closer to the exposed end of the sleeve than the unexposed end of the sleeve, a plate supported by the flange and providing a rest for the pole, a second sleeve surrounding the pole and extending into the first sleeve and engaging the pole, said second sleeve composed of separable sections extending the full length thereof, means detachably and adjustably connecting the sections above the surface of the ground to cause said sections to tightly grip the pole, and a downwardly extending flange formed integrally with and arranged exteriorly of the second sleeve and receiving the exposed end of the first sleeve.

U.S. Pat. No. 1,983,850 to Gordon discloses an anchor comprising cooperating shells which are half-cylinders closed at their lower ends, said shells being of plastic material molded and allowed to dry and then adapted for operative assembly on the lower end of a pole, and adjustable fastening means encircling the cooperating shells and having some slight inherent yield adapting the cooperating shells for relative expansion and contraction, the meeting edges of the shells having cooperating tongues and grooves, and the bore of the cooperating shells being counterbored for reception of a sealing medium between the pole and anchor.

U.S. Pat. No. 1,995,874 to Van De Mark discloses in combination with a pole: a plurality of reenforcing angle-bars spaced apart from each other and extending longitudinally of the pole; each angle-bar consisting of one longitudinal pole-engaging flange, and one longitudinal bracing-flange extending transversely from one longitudinal edge of a pole-engaging flange; and bolts connected to each bracing-flange and extending in opposite directions about the pole and pulling each bracing-flange in opposite directions transversely of the bracing-flanges.

U.S. Pat. No. 2,395,745 to King discloses a band clamp, wherein a strap having its opposite ends looped back to form eye means at each end of the strap, a T bolt having a cross member and a shank, said cross member being positioned within one of said eyes. Trunnion means within the other of said eyes, the shank of said T member extending through said trunnion member, and means for adjustably engaging the shank of said T bolt and said trunnion member to tighten said strap, said strap being aperture at said eyes to permit passage of the shank of said T bolt, and a split sleeve interposed between said cross member of said T bolt and said one eye, said split sleeve being aperture opposite the split therein for the passage therethrough of the shank of said T bolt.

U.S. Pat. No. 2,704,677 to Quest discloses a method of connecting adjacent extremities of flexible conduit sections including the steps of inserting a rigid tubular coupling member within one of said conduit sections with the free extremity of said conduit section projecting beyond the outer end of said coupling member, bending said projecting free extremity reversely Within the confines of said coupling member, inserting the extremity of said adjacent conduit section into the extremity of an adjacent conduit section a distance substantially equal to the length of the coupling member within said first mentioned conduit section so that the adjacent extremities of said conduit sections are overlapped upon said coupling member in surrounding relationship thereto, clamping Said overlapped extremities upon said coupling member, and introducing liquid pressure into said connected conduit sections in a direction opposite to that of the reversely bent extremity of said first mentioned conduit section whereby said bent extremity will be restored to substantial alignment with said first mentioned conduit section and a seal will be effected between said projecting extremity and the inner wall of the adjacent conduit section.

U.S. Pat. No. 2,713,352 to Schustack discloses a pipe coupling or pipe patch clamp comprising a split flexible sleeve member, the edges of the split portion being bent over to form hooks, the distance between the edges of the split portion being slightly less than the circumference of the pipe so that when the sleeve is placed around the pipe a gap will be formed between the hooks, a pair of rigid draw-blocks for said hooks, each draw-block having means for engaging a hook on the sleeve member, each block being L-shaped in cross section and extending radially outwardly from the sleeve when the block is in sleeve-engaging position and each draw-block having adjacent edges and extending radially of the axis of the sleeve, one of said edges providing means forming a pivot point of engagement between the adjacent edges, a bolt extending through said draw-blocks and adapted when tightened to bring said adjacent edges together and decrease the gap between the adjacent hooks.

U.S. Pat. No. 3,078,108 to Smith discloses a pipe coupling for spanning a pipe circumferentially, said coupling being divided along longitudinal edges into a plurality of coupling members, means for securing said coupling members together at said longitudinal edges into a single unit spanning the pipe circumferentially, said pipe coupling having a central portion intermediate its ends with a cylindrical inner wall of substantially greater diameter than the outer diameter of the pipe to define an annular chamber within the coupling around the pipe, said coupling having reduced portions at each end having a diameter substantially less than that of said annular chamber and adapted to receive the pipe therethrough, the axially inner ends of said reduced portions adjacent said chamber defining axially spaced internal circumferential shoulders, a pair of axially spaced deformable arcuate gasket elements carried by each of said coupling members at the inside thereof at the axially inward ends of the shoulders, the corresponding arcuate gasket elements on the coupling members being aligned end to end with each other and forming two spaced internal circumferential gaskets at the inside of the coupling to seal against the surface of the pipe when said coupling members are secured together, flexible girdering means for each circumferential gasket, means permanently and rigidly securing said girdering means to said coupling axially outward from the respective circumferential gasket, said girdering means extending axially only partially across the latter's radially inward face and termianting short of the latter's axially inward edge and extending radially inward beyond the outer periphery of the pipe to be coupled, each shoulder and the respective girdering means confining the respective circumferential gasket at its axially outward end and leaving the axially inward extremity of said gasket exposed at its radially and axially inward face, each of said girdering means being so constructed and arranged so as to be bendable radially outward by engagement of the outside of the pipe when said coupling members are secured together thereabout to deform the exposed extremity of the respective circumferential gasket into tight sealing engagement against the pipe and to trap said gasket against outward extrusion from fluid pressure in the pipe, each of said coupling members having a recess at the inside along each longitudinal edge between said arcuate gasket elements radially outward of said inner cylindrical wall, a deformable longitudinal gasket element seated in each recess and extending between said arcuate gasket elements, each of said longitudinal gasket elements having a radially and longitudinally extending sealing face which normally projects beyond the respective longitudinal edge of the respective coupling member, longitudinal girdering means rigidly secured to the inside of each coupling member adjacent each of said longitudinal recesses and extending only partially across the latter's radially inward side and terminating short of the sealing face of the latter, leaving the respective longitudinal gasket element exposed at the radially inward extremity of sealing face and spaced radially from the pipe within the coupling, and a retainer for each longitudinal gasket element at the latter's sealing face, each retainer having a first leg extending lengthwise of the respective longitudinal gasket element from the radially outward side thereof only partially across the latter's sealing face and terminating short of the radially inward extremity of said sealing face, each retainer having a second leg extending lengthwise of the respective longitudinal gasket element transversely from said first leg across the radially outward side of said longitudinal gasket element inside the recess which receives said longitudinal gasket element, said second leg on each retainer being substantially shorter circumferentially than the normal circumferential thickness of the respective longitudinal gasket element and terminating short of the bottom of the respective recess to permit the retainer to move circumferentially into the recess and compress the gasket element as the coupling members are brought into sealing engagement along their longitudinal edges, said second leg on each retainer member terminating at each longitudinal end in inturned extremities which extend snugly around the adjacent ends of the respective longitudinal gasket element.

U.S. Pat. No. 3,329,446 to Katis et al. discloses a pipe coupling for Joining two sections of pipe, said coupling consisting of a pair of identical resilient sheet metal clamp members each having semi-circular body members with integral, outwardly radially extending fastener receiving flanges at each end thereof, said body being substantially U-shaped in cross-section, the flanges being joined to the base of the U at each end by a smooth curved portion, said curved flange portions of one body member cooperating with the curved portions of the flanges on the adjacent body member to form tapered notches having their apices extending radially outwardly and the legs of the U terminating in the radial plane of said flanges at their respective ends, the ends of adjacent legs of the U being in abutting relation when the flanges are clamped in face contacting relation, thereby forming a stop, a circumferentially split tubular gasket positioned in said semi-circular body members between said flanges with the split in said tubular gasket in its inner circumference, radially outwardly, oppositely disposed transversely positioned outturned tapered extensions on said gasket shaped complementary to the shape of said notches, fasteners engaged through apertures in said flanges for moving said semi-circular body members toward one another and the ends of pipes to be joined thereby, said tapered extensions on said gasket being positioned in said tapered notches between the inner ends of said flanges, whereby said gasket is retained in position therebetween.

U.S. Pat. No. 3,485,515 to Frishof discloses a fluid coupling is provided whose housing body has a two-part or split-sleeve clamping lock type of assembly at each, of its opposite ends for removably-securing adjacent open end portions of a pair of tubing or thinwall pipe members therewithin. A lower sleeve part of each assembly is integrally secured, as by welding, to provide an endwise extension of the housing body. An opposite, upper, cooperating, removable sleeve part of each assembly is shown secured only by cooperating clamping feet or end flanges and nut and bolt assemblies to the lower sleeve part, on and about an open end portion of an associated pipe member. Cooperating peripheral interlatching tongue and groove portions enable the upper and lower sleeve parts of each assembly to be accurately aligned with each other and to positively retain an associated pipe member against endwise or axial movement out of the housing body when a coupled pipeline is being dragged endwise from one location to another. The lower sleeve part of each assembly serves as an anchor to which the upper sleeve part is removably secured. The housing body carries fluid-sensitive Vshaped gaskets for sealing-off the joints between it and the pipe members, and a sled-like skid is secured to extend longitudinally along the bottom portions of the housing body and the lower sleeve parts.

United States Patent 2003/0163960 to Hadden discloses a square riser with corner threaded rods is used to repair utility standards. The riser threaded rods are bolts with washers welded to the bolt heads. The utility standard base is removed from its footing with four threaded rods, the riser slid down over the footing threaded rods and welded to them. Nuts on the footing threaded rods are used to level the riser. The riser can if desired be filled with poured concrete, to strengthen and protect it. The utility standard base is then slid down over the riser threaded rods and secured by nuts. A sleeve made of two paired half shells snugly fitting the bottom of the utility standard above the base can be welded to the utility standard. Reinforcing brackets are sometimes welded to the middles of the half shells and to the standard base. On occasion both methods of repair may be combined. It is far cheaper to repair than replace utility standards. The methods and material meet all North American standards for utility standard repair.

United States Patent 2007/0036938 to Engelbrecht discloses a pillar protection assembly consisting of a plastic sleeve inside which a number of plastic foam blanket sections are arranged. The sleeve can be provided with information on the outside and has a closure so as to fix this to the pillar after it has been wrapped around the latter. The plastic foam material of the plastic foam blanket consists of a foam matrix in which particles are incorporated that preferably consist of a recycled material. The plastic foam material used can be polyether or polyurethane.

United States Patent 2008/0284162 to Piscitelli discloses a clamping assembly for joining pipe comprising a clamping band formed with a first retaining area and a second retaining area, having an axial split forming a first and second edge and a first tab disposed along the first edge of the axial split and a second tab along the second edge of the axial split, a first worm gear clamp for securing the clamping band to a first pipe section, a second worm gear clamp for securing the clamping band to a second pipe section, and at least one bolt for securing the first tab to the second tab for providing a sealed coupling of the first tab to the second tab and the first edge to the second edge, wherein coupling the first tab to the second tab provides for a seal of the first edge and the second edge such that the pipe join is sealed.

United States Patent 2009/0236579 to Sudnak discloses a post protector shaped such that any grass or weed cutting mechanism is deflected away from the post thereby avoiding superficial or serious damage to the post. In the preferred embodiment the post protector incorporates an indented center section having specific geometries that resist the cutting mechanism from passing over the top portion or below the bottom portion of the protector. The protector is formed of two detachable halves for ease in installation or removal.

United States Patent 2009/0308017 to Kadoya et al. discloses a reinforcing bar anchorage in accordance with the present invention includes a sleeve having an ellipsoidal cross-sectional shape, an anchoring member, and a wedge member. The anchoring member includes a steel plate having a substantially circular plate-like body and a connection rod provided upright on the steel plate. The connection rod is formed from a straight steel rod having a circular cross-section. The sleeve is configured such that the connection rod and the reinforcing bar can be inserted thereinto while the connection rod and the reinforcing bar can be parallel to each other so as to overlap each other by a predetermined length. Wedge insertion holes, are formed in the sleeve between the reinforcing bar and the connection rod so as to be opposed to each other. A wedge member is designed to be inserted into the wedge insertion holes, for press-fitting.

United States Patent 2010/0088995 to Murayama discloses a reinforcing bar joint according to the present invention includes an elliptic-sectioned sleeve, a load transfer rod to be inserted through the sleeve, and wedging means. The sleeve is configured so that end portions of reinforcing bars, can be inserted into openings, formed in respective ends of the sleeve so that the reinforcing bars are arranged in series along an identical line. The load transfer rod can also be inserted therethrough in parallel with the end portions of the reinforcing bars, which are inserted into the sleeve.

United States Patent 2012/0255259 to Shute discloses an apparatus for repairing the rail of a split-rail fence having a broken tapered end portion. The apparatus has elongate, hollow sleeve with a base portion and a tapered end portion. The base portion and end portion have a shape that compliments the shape of the central base portion and tapered end portion of the rail, respectively, and have interior cross-sectional dimensions that are larger than the exterior cross-sectional dimensions of the central base portion and tapered end portion of the rail, respectively. The sleeve can slide over and encase the tapered end and at least a portion of the central base portion of the rail. The apparatus preferably includes means for fastening the base portion of the sleeve to the base portion of the rail.

United States Patent 2015/0013267 to Huncovsky discloses a pole splint, generally for use with a broken wooden utility pole, which can provide for a strong repair at a pole breakpoint and which uses relatively little manpower and equipment to install, even under difficult conditions. The splint generally comprises two panels which are designed to be interconnected with elongated connectors. The connectors will generally interact with one of the panels through the use of a nut and washer, and may connect with the other panel through a nut and washer or via a chain formed of chain links.

United States Patent 2015/0082742 to Catt et al. discloses a metal post reinforcement arrangement adapted to be clamped about a broken section of a metal post, including two opposing brackets wherein when a bolt fixes one bracket to the other about the metal post the bolt divides the broken section into upper and lower portions so as to provide support and/or structural integrity when the reinforcement arrangement is clamped about the broken section and wherein each bracket has a substantially semi circular cross-sectional configuration along said bracket length that includes a longitudinal central segment terminating on opposed sides with internally directed curved edges with corresponding upwardly extended rounded shoulders that provide substantially triangular dimples on the internal side of the bracket, and wherein a peripheral flange stems out from a rounded dip from each substantially triangular dimple such that said brackets are adapted to be fixed around metal posts having different shapes.

Although the aforementioned prior art have contributed to the development of the art of a pipe coupler none of these prior art patents have solved the needs of this art. Therefore, it is an object of the present invention to provide an improved pipe coupler which is a significant advancement over the prior art.

Another object of this invention is to provide an improved pipe coupler that is easy for the repairer to remove only part of the damaged cylindrical top rail of the fence.

Another object of this invention is to provide an improved pipe coupler is that only part of the cylindrical top rail must be replaced instead of the cylindrical top rail whole section.

Another object of this invention is to provide an improved pipe coupler that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a a pipe coupler for a chain link fence. The chain link fence consists of many hollow pipes which are design to holdup a metal fabric. This metal fabric provides some privacy and protection, and set boundaries for pets and outsiders. A pipe coupler comprises a cylindrical body wall and having a primary socket and a secondary socket. The primary socket has a primary aperture and a primary channel. The secondary socket has a secondary aperture, a secondary channel, and a socket door. The primary socket has a larger diameter than the first chain link top rail for receiving and circumferentially engaging the existing or replacement chain link top rail. The secondary socket has a larger diameter than the second chain link top rail for receiving and circumferentially engaging the existing or replacement chain link top rail. The secondary socket also includes a socket groove. The socket groove has a width greater than the existing or replacement chain link top rail for positioning the existing or the replacement chain link top rail through the socket groove and into the secondary channel. The secondary socket includes a socket door which covers the socket groove and preventing the removal of the existing or the replacement chain link top rail from the secondary socket. The pipe coupler has a flexible strap has a proximal and a distal end. The flexible strap is fastened to the pipe coupler at the proximal end and is fastened to the socket door at the distal end. The flexible strap couples the socket door with the pipe coupler for pivoting the socket door relative to the pipe coupler. A clamp is used to maintain the socket door over the socket groove, keeping the existing or the replacement chain link top rail within the socket groove.

In another embodiment, the invention is incorporated into the pipe coupler comprises a cylindrical body wall and having a primary socket and a secondary socket. The primary socket has a primary aperture and a primary channel. The secondary socket has a secondary aperture and a secondary channel. The primary socket has a larger diameter than the first chain link top rail for receiving and circumferentially engaging the existing or replacement chain link top rail. The secondary socket has a larger diameter than the existing or replacement chain link top rail for receiving and circumferentially engaging the existing or replacement chain link top rail. The secondary socket also includes a socket groove. The socket groove extends less than half the total length of the pipe coupler. The socket groove has an opening at least 180 degrees. The socket groove has a width greater than the existing or replacement chain link top rail for positioning the existing or replacement chain link top rail through the socket groove and into the secondary channel. The secondary socket includes a socket door covering the socket groove and preventing the removal of the existing or replacement chain link top rail from the secondary socket. The pipe coupler has a flexible strap which has a proximal and a distal end. The flexible strap is fastened to the pipe coupler at the proximal end and is fastened to the socket door at the distal end. The flexible strap couples the socket door with the pipe coupler for pivoting the socket door relative to the pipe coupler. A clamp is used to maintain the socket door over the socket groove, keeping the existing or replacement chain link top rail within the socket groove.

In still another embodiment, the invention is incorporated into the pipe coupler comprises a cylindrical body wall and is constructed of metal, aluminum, galvanized steel, plastic, or PVC. The pipe coupler has a stop surface extending radially inward and being engageable with the existing chain link top rail and the replacement chain link top rail to prevent the existing chain link top rail or the replacement chain link top rail from passing through the pipe coupler. The pipe coupler has a primary socket and a secondary socket. The primary socket has a primary aperture and a primary channel. The secondary socket has a secondary aperture and a secondary channel. The primary socket has a larger diameter than the first chain link top rail for receiving and circumferentially engaging the existing or the replacement chain link top rail. The secondary socket has a larger diameter than the second chain link top rail for receiving and circumferentially engaging the existing or the replacement chain link top rail. The secondary socket also includes a socket groove. The socket groove extends less than half the total length of the pipe coupler. The socket groove has an opening at least 180 degrees. The socket groove has a width greater than the existing and the replacement chain link top rail for positioning either the existing or the replacement chain link top rail through the socket groove and into the secondary channel. The secondary socket includes a socket door covering the socket groove and preventing the removal of the existing or the replacement chain link top rail from the secondary socket. The pipe coupler has a flexible strap has a proximal and a distal end. The flexible strap is fastened to the pipe coupler at the proximal end and is fastened to the socket door at the distal end. The flexible strap couples the socket door with the pipe coupler for pivoting the socket door relative to the pipe coupler. A clamp is used to maintain the socket door over the socket groove, keeping the existing or the replacement chain link top rail within the socket groove.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Replacing a damaged cylindrical pipe in a chain link fence system has been troublesome and required a great deal of man hours to perform. Of all the cylindrical pipes in a fence system, the cylindrical top rail is usually the pipe that gets damaged. FIGS. 3-9, 14-17 illustrate a pipe coupler 32 for joining a replacement cylindrical rail 34 portion to an existing cylindrical rail 36 portion typically when the cylindrical top rail 38 has been damaged.

Figure 1:
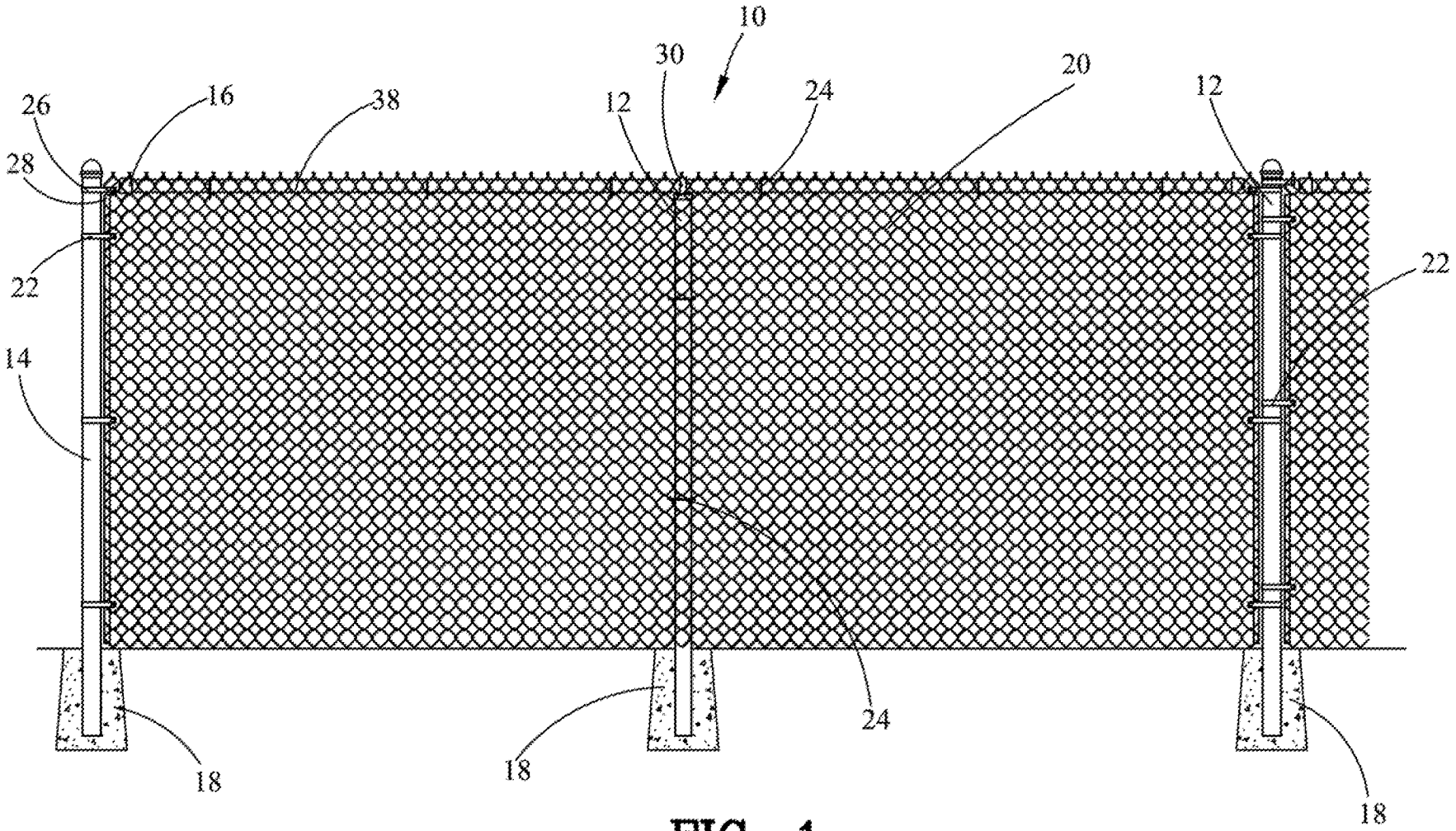
FIG. 1 is a view of an undamaged chain-link fence.

FIG. 1 shows a section of an undamaged chain link fence 10. An undamaged chain link fence 10 has a terminal post 14 which is held in place by concrete 18. The function of the terminal post 14 is to give framing for the chain link fabric 20 and is located at beginnings, ends, intersections, and at corners of the chain link fence 10. Chain link fence 10 sections that expand over a considerable distance will also include line posts 12 which function as intermediary between the terminal posts 14 to hold up the chain link fabric 20. To finish the structure of the chain link fence 10, a cylindrical top rail 38 runs, typically horizontally, from terminal post 14 to another terminal post 14. The chain link fabric 20 is secured to the terminal posts 14 by having a tension bar 28 running vertically through the chain link fabric 20 in which the tension bar 28 is secured to the terminal post 14 by means of tension bands 22. The chain link fabric 20 is secured to the cylindrical top rail 38 and the line posts 12 by means of fence ties 24.

Figure 2:
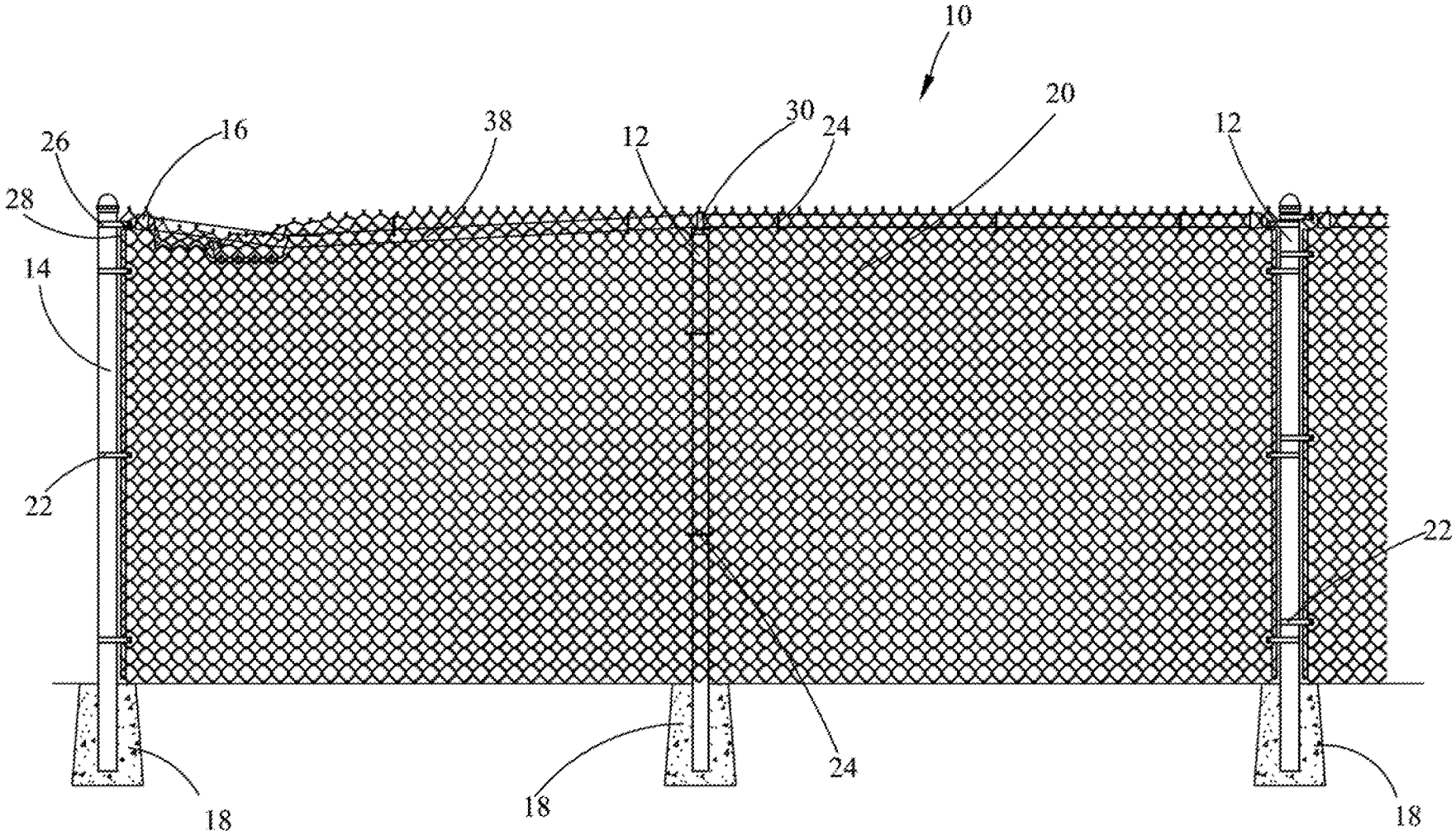
FIG. 2 is similar to FIG. 1 wherein the chain-link fence has been damaged.

FIG. 2 shows the same section of the chain link fence 10 as in FIG. 1 except for the cylindrical top rail 38 that has sustained damage.

Figure 3:
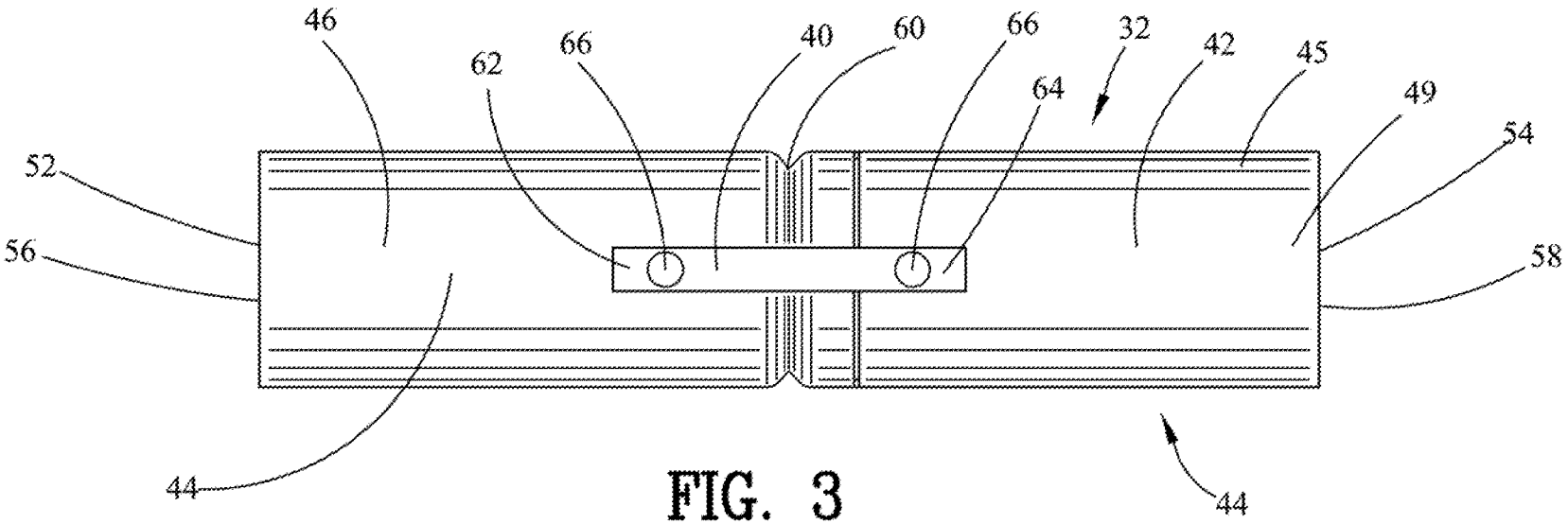
FIG. 3 is a top view of the pipe coupler.

FIG. 3 is a top view of the present invention pipe coupler 32 showing the pipe coupler 32 that is constructed with a cylindrical body wall 44 and having a primary socket 46 and a secondary socket 48. The primary socket 46 has a larger cylindrical diameter than the cylindrical top rail 38 of the chain link fence 10 for slidably receiving and engaging with the end of one of the cylindrical top rail 38 portion. The secondary socket 48 also has a larger cylindrical diameter than the cylindrical top rail 38 than that of the socket groove 50 for receiving and engaging with one of the cylindrical top rail 38 portion.

FIG. 3 also shows a flexible strap 40, a socket door 42, and a stop surface 60. FIG. 3 illustrate the socket door 42 for covering the socket groove 50 thereby preventing the separation of the replacement cylindrical rail 34 portion or the existing cylindrical rail 36 portion. The flexible strap 40 that has a proximal end 62 and a distal end 64. The flexible strap 40 is fastened to the pipe coupler 32 at the proximal end 62 and is fastened to the socket door 42 at the distal end 64 either by welds, bolts or pop rivets 66, typically. The flexible strap 40 couples the socket door 42 with the pipe coupler 32 for pivoting the socket door 42 relative to the pipe coupler 32. The socket door 42 covers the socket groove 50 thereby preventing the separation of the replacement cylindrical rail 34 portion or the existing cylindrical rail 36 portion from being removed from the secondary socket 48. The pipe coupler 32 has a stop surface 60 that extends radially inward and being engageable with an end of one of the cylindrical top rail 38 to prevent the cylindrical top rail 38 from passing through the pipe coupler 32.

Figure 4:
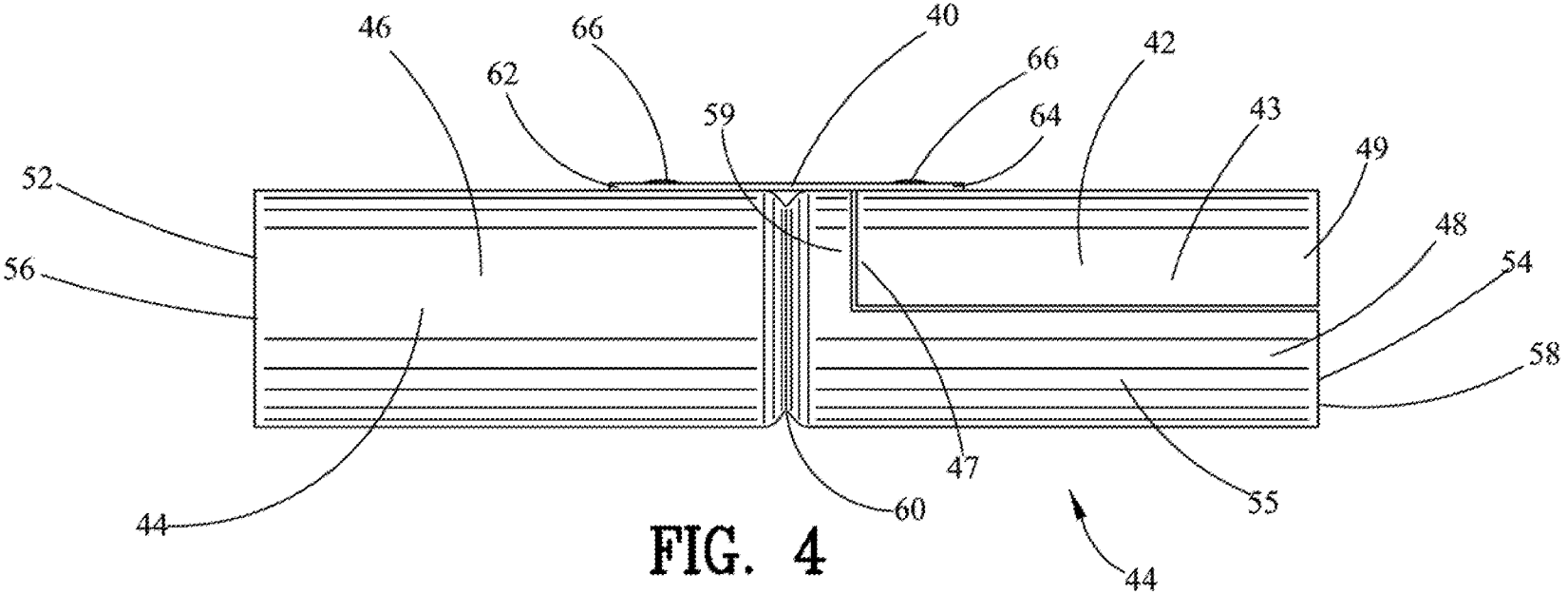
FIG. 4 is a side view of the pipe coupler shown in FIG. 3.

FIG. 4 is a side view of FIG. 3 showing the socket door 42 the primary socket 46 the secondary socket 48 the stop surface 60, and the flexible strap 40.

Figure 5:
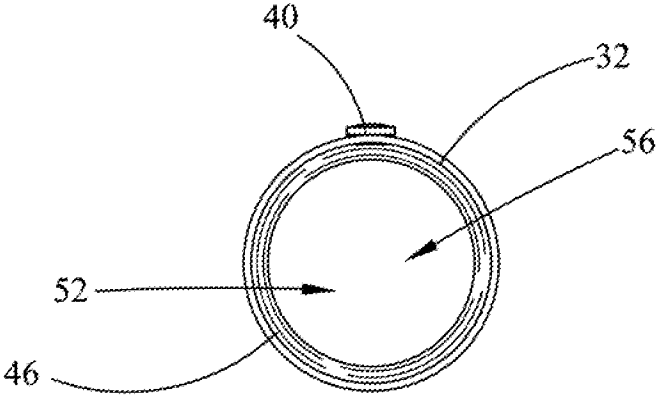
FIG. 5 is an end view of the pipe coupler shown in FIG. 3 with the primary socket in the foreground and the secondary socket in the background.

FIG. 5. shows the pipe coupler 32 having a primary socket 46, a primary aperture 52, and a primary channel 56 all of which are in the foreground. The primary socket 46 shown in FIG. 5 has a diameter larger than the cylindrical top rail 38 for receiving and circumferentially engaging the cylindrical top rail 38.

Figure 6:
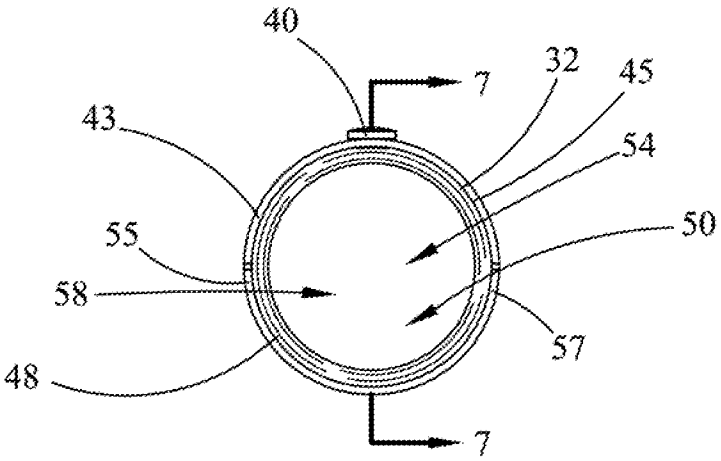
FIG. 6 is similar to FIG. 5 except the secondary socket in the foreground and the primary socket in the background.

FIG. 6 shows the pipe coupler 32 having the secondary socket 48, the secondary aperture 54, and a secondary channel 58 all of which are in the foreground. The socket groove 50 and secondary socket 48 shown in FIG. 6 has a larger diameter than the diameter of the cylindrical top rail 38 for receiving and circumferentially engaging the cylindrical top rail 38.

The socket groove 50 extends less than half the total length of the pipe coupler 32 and has an opening at least 180° for the insertion of the cylindrical top rail 38.

Figure 7:
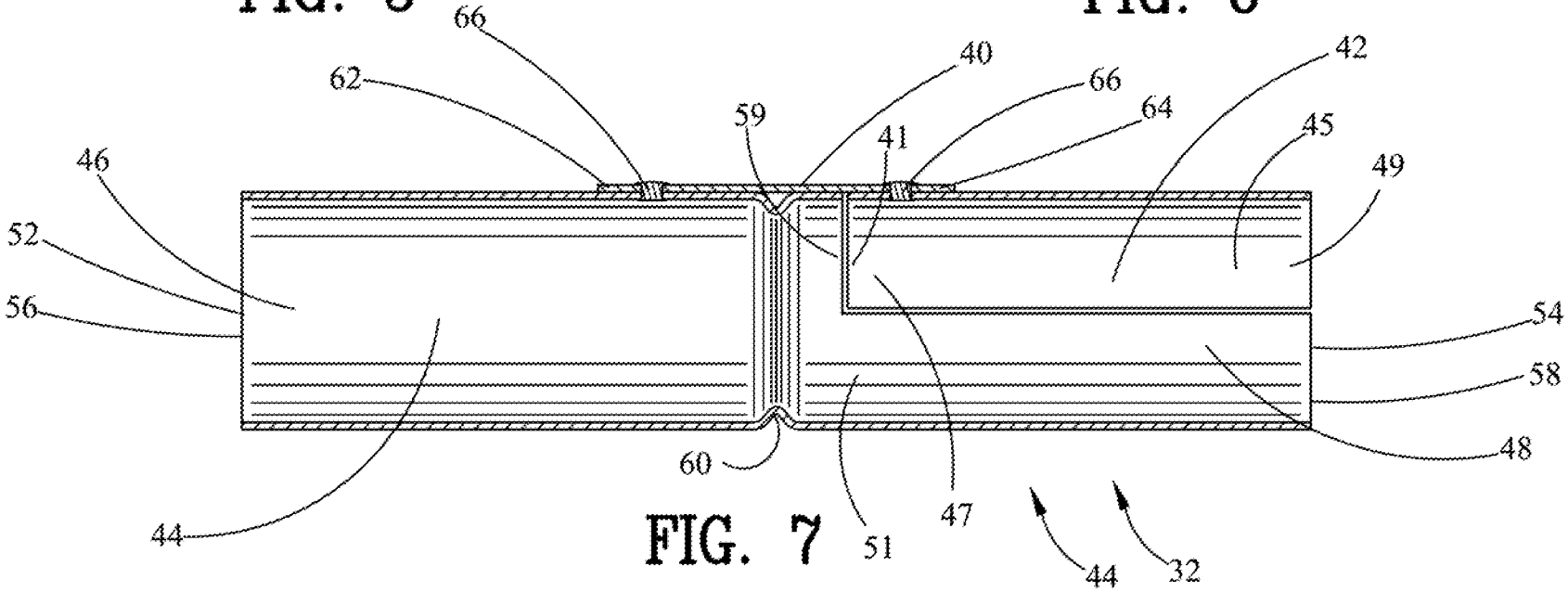
FIG. 7 is a sectional view a long line 7-7 in FIG. 6.

FIG. 7 is a sectional view along the line 7-7 in FIG. 6. FIG. 7 shows the primary socket 46, the secondary socket 48, the stop surface 60, the socket door 42, and the flexible strap 40.

Figure 8:
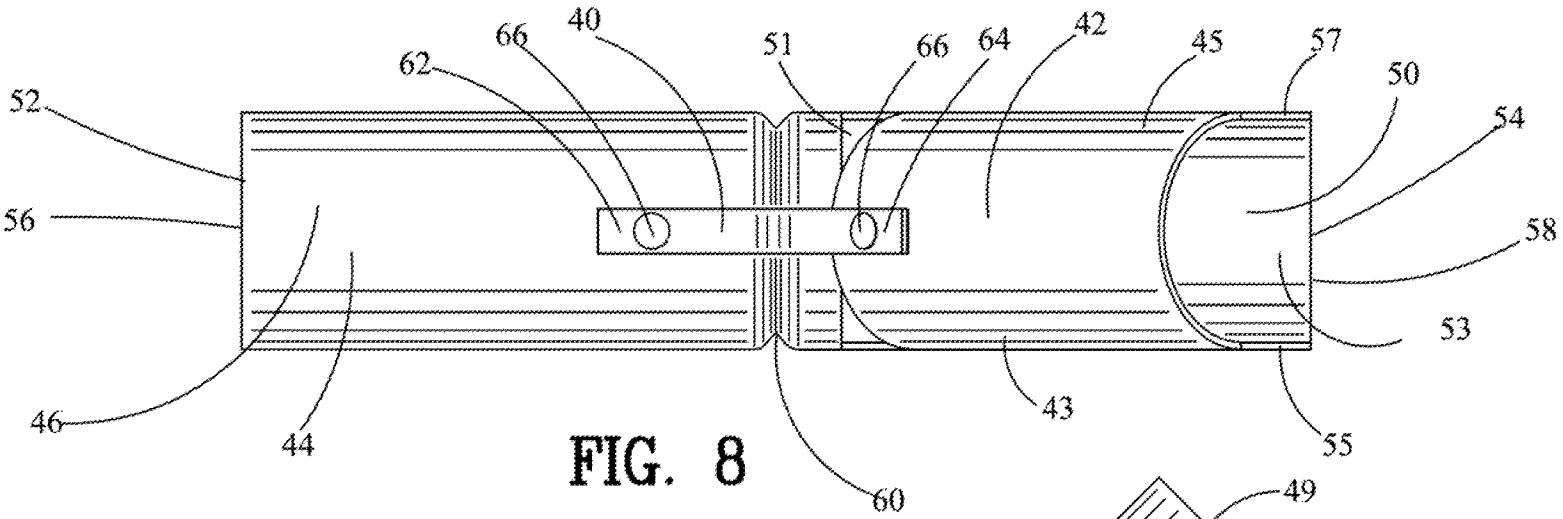
FIG. 8 is a top view with a socket door partially open.

FIG. 8 is similar to FIG. 3 in that it shows a top view of the pipe coupler 32 with the socket door 42 partially open. FIG. 8 also shows a second horizontal wall 57 that extending from the socket groove proximal end 51 to the socket groove distal end 53.

Figure 9:
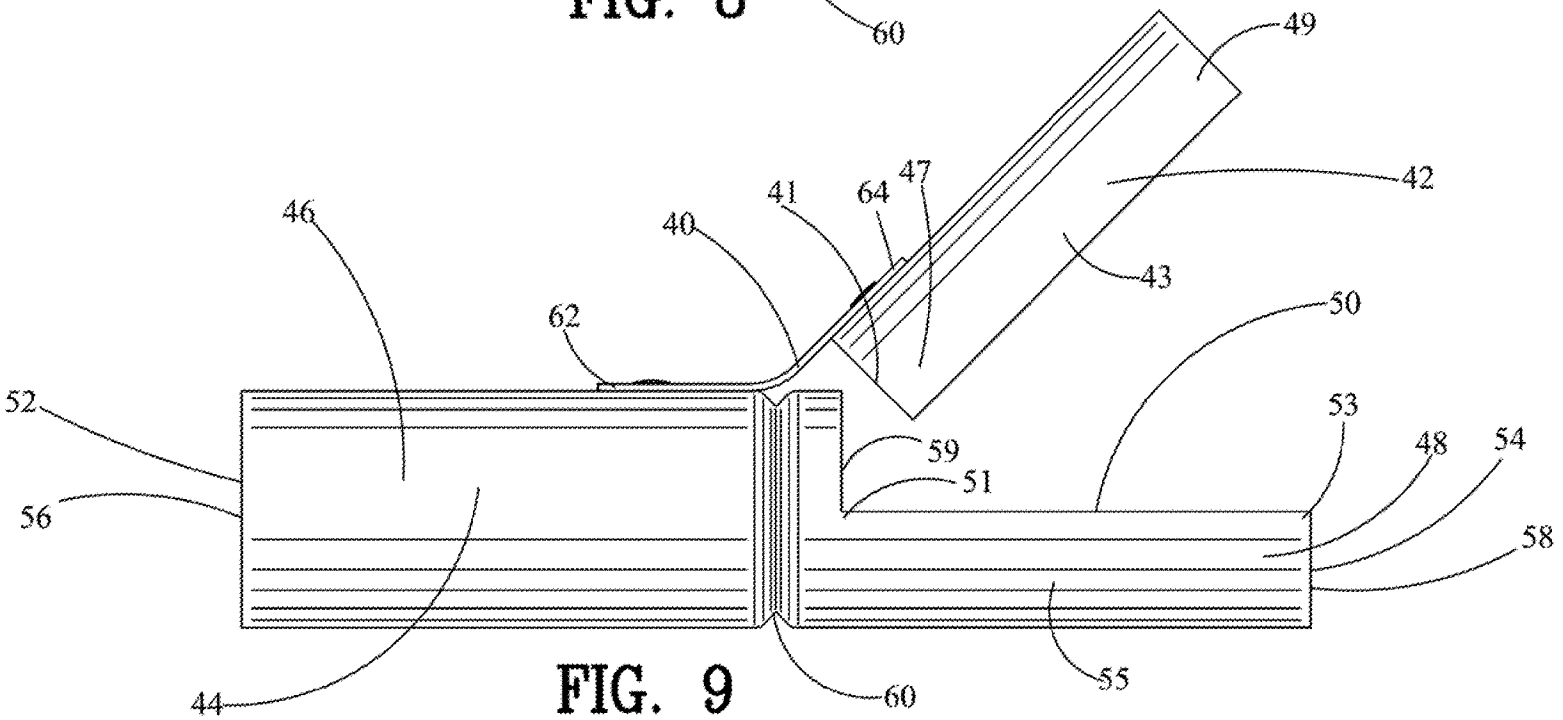
FIG. 9 is a side view shown in FIG. 8 with the socket door partially open.

FIG. 9 is similar to FIG. 4 in that it shows a side view of the pipe coupler 32 with the socket door 42 partially open. Also shown in FIG. 9, is the socket groove 50 having a vertical wall 59 that extends outwardly at the socket groove proximal end 51, and a first horizontal wall 55 extending from the socket groove proximal end 51 to the socket groove distal end 53.

The socket door 42 is a pivoting closure having a pivoting vertical wall 41, a first pivoting horizontal wall 43, and a second pivoting horizontal wall 45 shown in FIG. 8. The pivoting vertical wall 41 is arcuate and defining the edge of the socket door proximal end 47. The first pivoting horizontal wall 43 extends from the socket door proximal end 47 to the socket door distal end 49. The second pivoting horizontal wall 45, shown in FIG. 8, extends from the socket door proximal end 47 to the socket door distal end 49. When the socket door 42 is closed, the first pivoting horizontal wall 43 will contact the first horizontal wall 55, the second pivoting horizontal wall 45, shown in FIG. 8, will contact the second horizontal wall 57, shown in FIG. 8, and the pivoting vertical wall 41 will contact the vertical wall 59. With the socket door 42 closed, the socket door 42 and the socket groove 50 are in contact which creates a cylindrical body.

Figure 10:
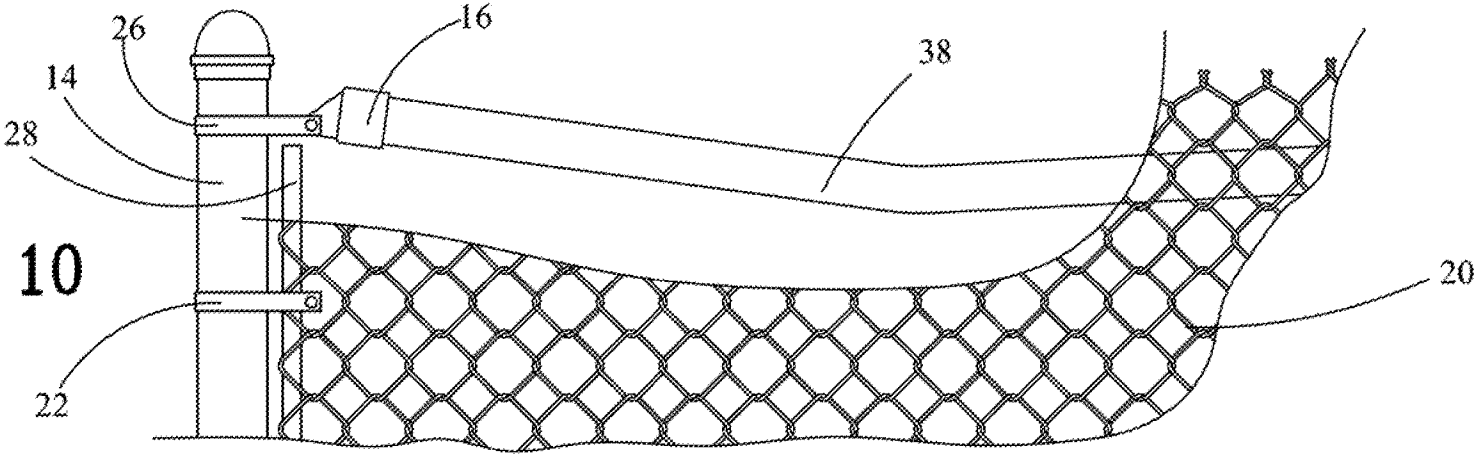
FIG. 10 is an enlarged view of the damage section in FIG. 2.

FIG. 10 is an exploded view of the damaged portion of the cylindrical top rail 38 with the chain link fabric 20 removed from view.

Figure 11:
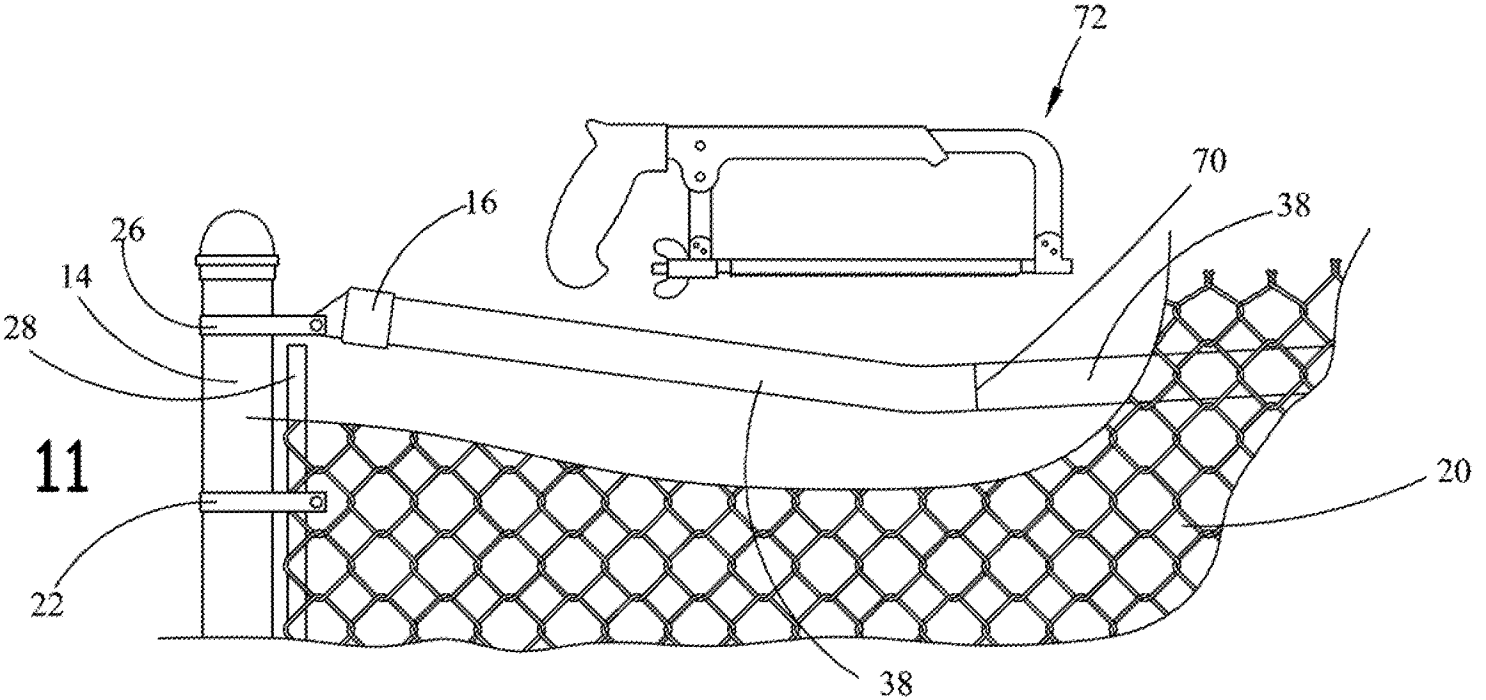
FIG. 11 is similar to FIG. 10 but including a cutting device and a cutting mark.

FIG. 11 exhibits the cutting tool 72 and a proximate location to the cut line 70 of the cylindrical top rail 38 that must be cut and removed before the replacement cylindrical rail 34 and pipe coupler 32 can be installed.

Figure 12:
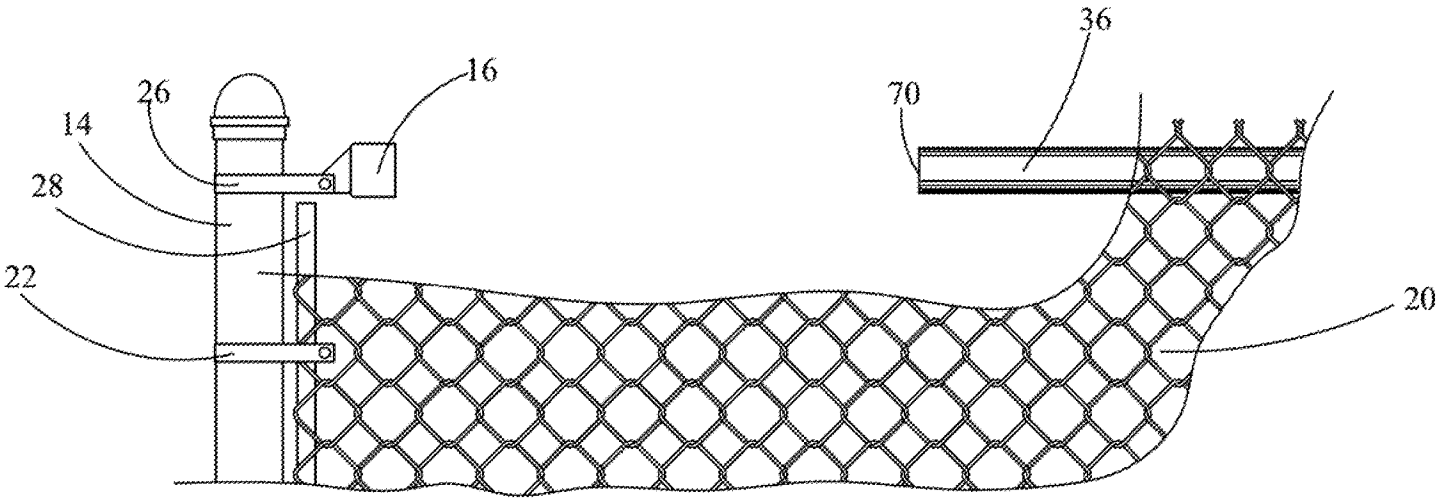
FIG. 12 is similar to FIG. 11 with the damaged portion of the cylindrical top rail removed.

FIG. 12 shows the damaged cylindrical top rail 38 section of a chain link fence has been removed and is awaiting the replacement cylindrical rail 34 section.

Figure 13:
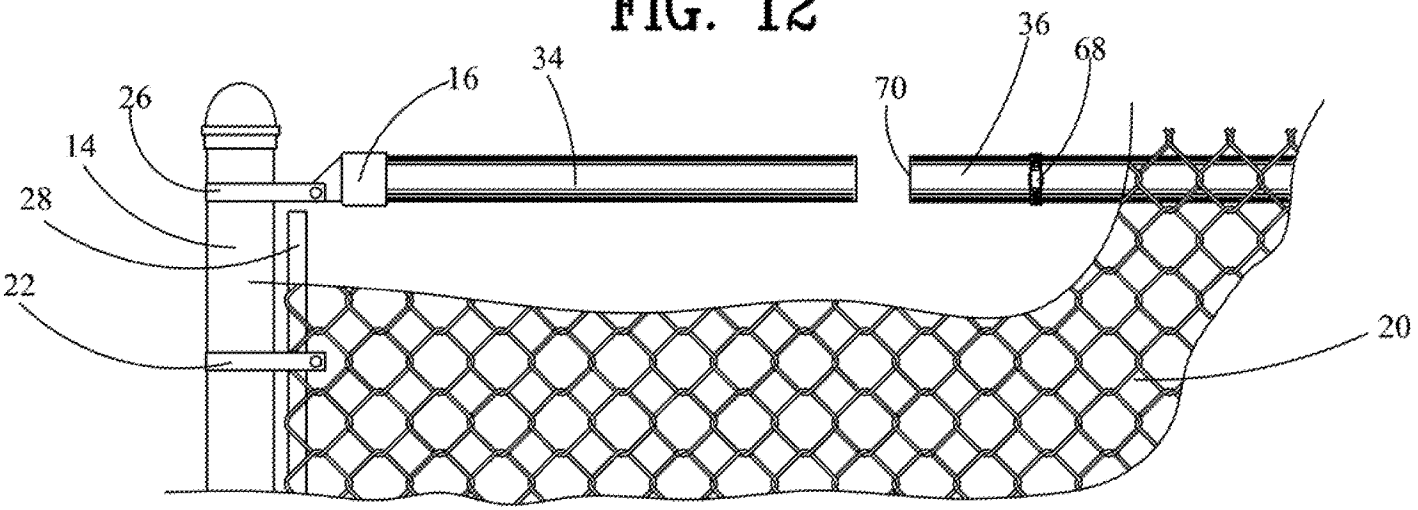
FIG. 13 is similar to FIG. 12 with the replacement cylindrical rail.

FIG. 13 shows the replacement cylindrical rail 34 section installed. Under current techniques the terminal post 14 must be pulled away from the existing cylindrical rail 36 portion in order to get a replacement cylindrical rail 34 using a standard pipe coupler. This however is not possible because the terminal post 14 is typically cemented 18 into the ground and the chain link fabric 20 does not give enough slack to angle the terminal post 14 away, which would be required to install a prior art pipe coupler.

Figure 14:
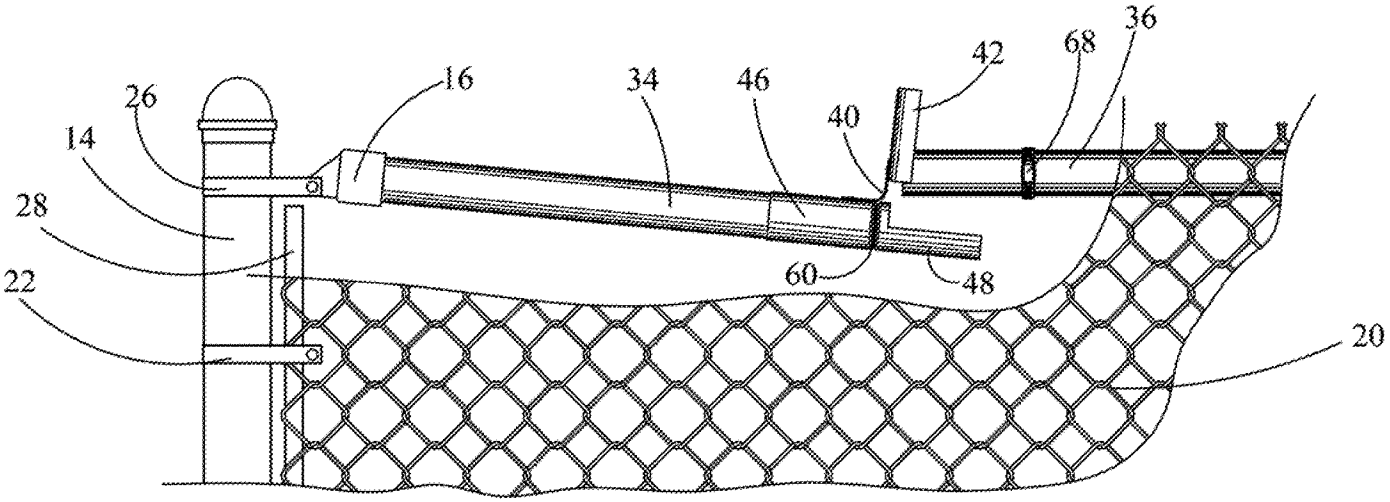
FIG. 14 has the present invention whereas the replacement cylindrical rail is inserted in the primary socket and is angled away from the existing cylindrical rail with the socket door open.

FIG. 14 shows the present invention allowing the joining of a replacement cylindrical rail 34 portion to the existing cylindrical rail 36 portion without the required movement of the terminal post 14. It is also shown in FIG. 14 that the replacement cylindrical rail 34 portion has been installed into the primary socket 46 and is all angled away from the existing cylindrical rail 36 portion. This facilitates the installation of the existing cylindrical rail 36 portion into the socket groove 50 of the pipe coupler 32. It does not matter which direction the pipe coupler 32 is installed. The installer can just as easily install the existing cylindrical rail 36 in to the primary socket 46 and the replacement cylindrical rail 34 into the socket groove 50. The pipe coupler 32 is slid first on to one of either the replacement cylindrical rail 34 portion or the existing cylindrical rail 36 portion until the portion hits the stop surface 60 within the pipe coupler 32. With the pipe coupler 32 angled away, along with the replacement cylindrical rail 34 portion from the chain link fence 10, the installer then opens the socket door 42 revealing the socket groove 50. Then with the socket door 42 open the installer next angles the pipe coupler 32 and the replacement cylindrical rail 34 portion together back towards the existing cylindrical rail 36 portion where as the existing cylindrical rail 36 section can be inserted into the socket groove 50 as shown in FIG. 15.

Figure 15:
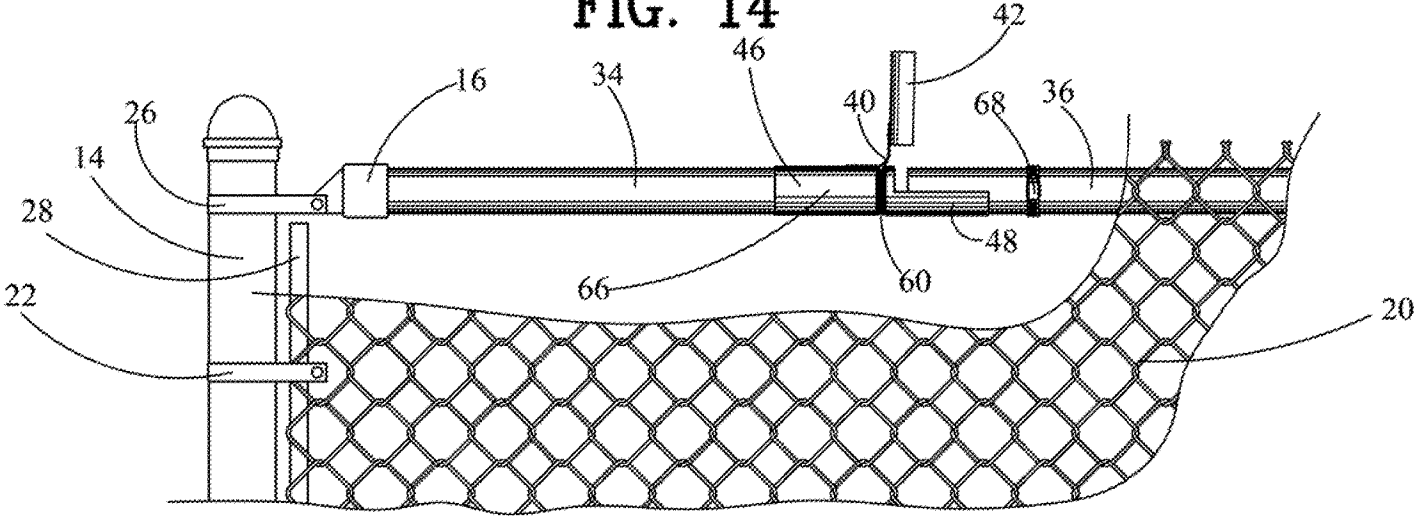
FIG. 15 is similar to FIG. 14 with the present invention whereas the replacement cylindrical rail is inserted into the primary socket and the existing cylindrical rail is inserted into the groove of the second socket.

FIG. 15 shows the replacement cylindrical rail 34 portion has been inserted into the primary socket 46 of the pipe coupler 32 and the existing cylindrical rail 36 portion has been inserted into the socket groove 50. FIG. 15 also shows a clamp 68 that maintains the socket door 42 over the socket groove 50 once repairs have been completed.

Figure 16:
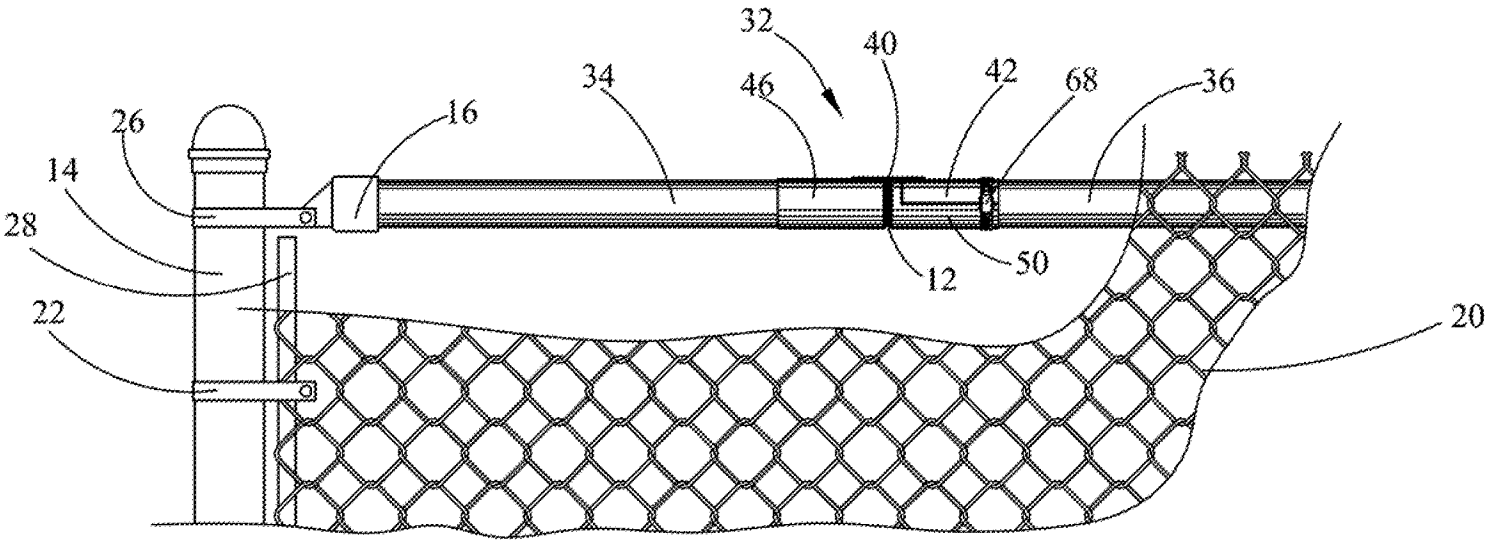
FIG. 16 is similar to FIG. 15 with the present invention installed with the clamp fastened around the closed socket door.
Figure 17:
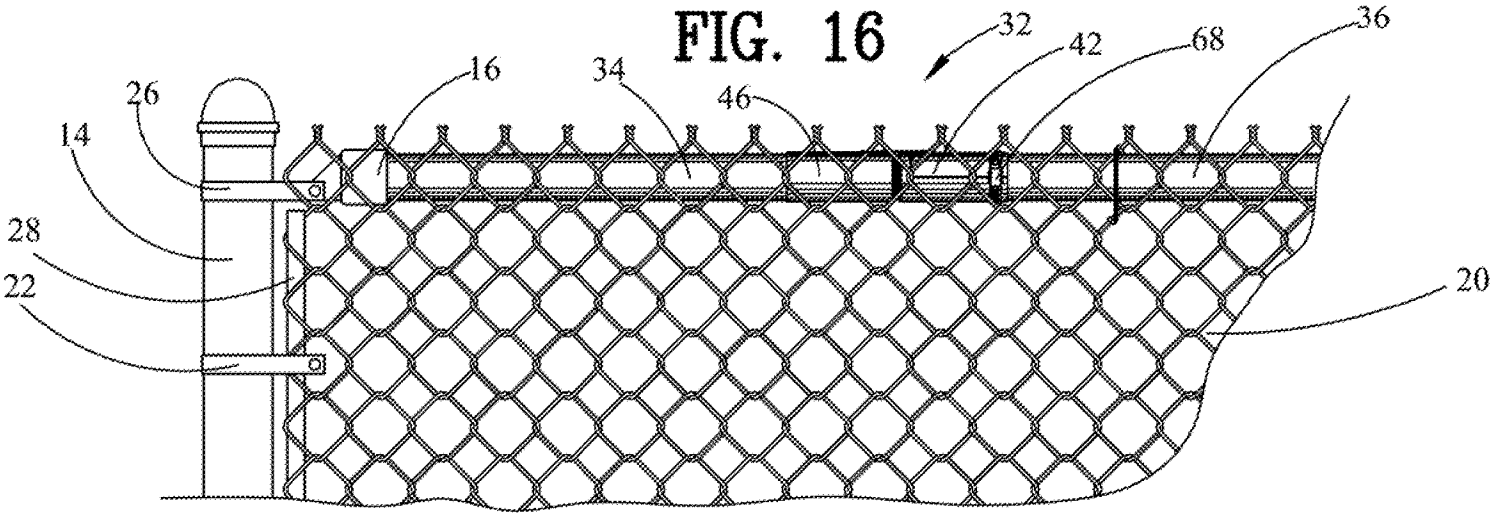
FIG. 17 is similar to FIG. 16 with the chain-link fabric no longer hidden from view.

FIG. 16 shows the socket door 42 which has been closed over the socket groove 50 and held in place with the clamp 68 and the flexible strap 40. The socket door 42 being closed will retain the existing cylindrical rail 36 within the secondary socket 48. FIG. 17 shows a completed installation of the pipe coupler 32 within the chain link fence 10.

The pipe coupler 32 can be constructed from a variety of materials such as metal, aluminum, galvanized steel, plastic or PVC. The flexible strap 40 may also be constructed from materials such as metal, aluminum, or galvanized steel.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A fence repair device for coupling a first cylindrical top rail and a second cylindrical top rail of a chain link fence, the fence repair device comprising:

a pipe coupler having a cylindrical body wall having a primary socket having a fixed diameter and a secondary socket;

said fixed diameter of said primary socket having a cylindrical opening configured for slidably engaging with the first cylindrical top rail of the chain link fence;

said secondary socket comprising a socket groove and a complimentary socket door which combine to define a cylindrical opening configured for receiving the second cylindrical top rail of the chain link fence;

a flexible strap having a proximal end and a distal end; said flexible strap is fastened to said primary socket at said proximal end of said strap and fastened to said socket door at said distal end of said strap such that said flexible strap pivotally couples said socket door with said pipe coupler;

said socket groove having an opening being configured for laterally transitioning the second cylindrical top rail of the chain link fence from adjacent to said pipe coupler and into said secondary socket;

a socket door for covering said socket groove to prevent the separation of the second cylindrical top rail of the chain link fence from said pipe coupler; and a clamp encircling said secondary socket and said socket door for maintaining said socket door over said socket groove.

2. The device, as set forth in claim 1, wherein said pipe coupler is constructed of metal, aluminum, galvanized steel, plastic, or PVC.

3. The device, as set forth in claim 1, wherein said flexible strap is secured to said pipe coupler and said socket door at said proximal end and said distal end, respectively by welds.

4. The device, as set forth in claim 1, wherein said flexible strap is secured to said pipe coupling and said socket door at said proximal end and said distal end, respectively by bolts.

5. The device, as set forth in claim 1, wherein said flexible strap is secured to said pipe coupler and said socket door at said proximal end and said distal end, respectively by pop rivets.

6. The device, as set forth in claim 1, wherein said socket groove extends less than half the total length of said pipe coupler.

7. The device, as set forth in claim 1, wherein said opening is least 180 degrees.

8. The device, as set forth in claim 1, wherein said pipe coupler has a stop surface extending radially inward and being engageable with the first cylindrical top rail and the second cylindrical top rail for preventing the first cylindrical top rail and the second cylindrical top rail from passing through said pipe coupler.

* * * * *